US010504712B2

(12) United States Patent
Jiang et al.

(10) Patent No.: US 10,504,712 B2
(45) Date of Patent: Dec. 10, 2019

(54) MASS SPECTROMETRY DEVICE AND ANALYSIS METHOD FOR GAS PHASE MOLECULE-ION REACTION

(71) Applicant: National Institute of Metrology, China, Beijing (CN)

(72) Inventors: You Jiang, Beijing (CN); Xiang Fang, Beijing (CN); Xing-Chuang Xiong, Beijing (CN); Ze-Jian Huang, Beijing (CN)

(73) Assignee: National Institute of Metrology, China, Beijing (CN)

( * ) Notice: Subject to any disclaimer, the term of this patent is extended or adjusted under 35 U.S.C. 154(b) by 0 days.

(21) Appl. No.: 15/564,736

(22) PCT Filed: Mar. 23, 2016

(86) PCT No.: PCT/CN2016/077113
§ 371 (c)(1),
(2) Date: Oct. 5, 2017

(87) PCT Pub. No.: WO2016/184252
PCT Pub. Date: Nov. 24, 2016

(65) Prior Publication Data

US 2018/0108523 A1 Apr. 19, 2018

(30) Foreign Application Priority Data

May 18, 2015 (CN) ..... 2015 1 0254326

(51) Int. Cl.
*H01J 49/24* (2006.01)
*H01J 49/04* (2006.01)
(Continued)

(52) U.S. Cl.
CPC ..... *H01J 49/26* (2013.01); *H01J 49/04* (2013.01); *H01J 49/10* (2013.01); *H01J 49/24* (2013.01); *H01J 2237/18* (2013.01)

(58) Field of Classification Search
None
See application file for complete search history.

(56) References Cited

U.S. PATENT DOCUMENTS

2004/0135080 A1* 7/2004 Ouyang ..... H01J 49/422 250/292
2006/0156980 A1* 7/2006 Won ..... C23C 16/45544 118/715
(Continued)

FOREIGN PATENT DOCUMENTS

CN 102169791 A 8/2011
CN 103354203 A 10/2013
(Continued)

*Primary Examiner* — James Choi
(74) *Attorney, Agent, or Firm* — CKC & Partners Co., LLC

(57) ABSTRACT

A mass spectrometry device comprises a reaction gas introduction device and a gas phase molecule-ion reaction mass spectrometry analysis device, wherein the reaction gas introduction device is connected to the gas phase molecule-ion reaction mass spectrometry analysis device; the reaction gas introduction device is configured to introduce reaction gas into the gas phase molecule-ion reaction mass spectrometry analysis device; and the gas phase molecule-ion reaction mass spectrometry analysis device is configured to enable molecules or ions to be subjected to a reaction and carry out mass spectrometry analysis on a reaction result. The reaction gas introduction device comprises a reaction gas container, the reaction gas container being configured to contain gas or volatile liquid or solid and generate gas molecules needed by a reaction; and a reaction gas quantitation device, configured to carry out flow control on the gas molecules.

6 Claims, 4 Drawing Sheets

(51) Int. Cl.
*H01J 49/26* (2006.01)
*H01J 49/10* (2006.01)

(56) References Cited

U.S. PATENT DOCUMENTS

| | | | | |
|---|---|---|---|---|
| 2008/0203288 | A1* | 8/2008 | Makarov | H01J 49/004<br>250/282 |
| 2016/0111269 | A1* | 4/2016 | Fedosenko | H01J 49/145<br>250/283 |

FOREIGN PATENT DOCUMENTS

| | | | | |
|---|---|---|---|---|
| CN | 103700566 | A | 4/2014 | |
| CN | 104201086 | A | 12/2014 | |
| CN | 104882352 | A | 9/2015 | |
| WO | 2007102204 | A1 | 9/2007 | |
| WO | WO 2015003819 | A1 * | 1/2015 | H01J 49/145 |

* cited by examiner

MASS SPECTROMETRY DEVICE AND ANALYSIS METHOD FOR GAS PHASE MOLECULE-ION REACTION

RELATED APPLICATIONS

This application is a continuation of International application No. PCT/CN2016/077113, filed on Mar. 23, 2016 which claims the benefits of priority of CN application No. 201510254326.1, filed on May 18, 2015, the content of which are incorporated herein by reference.

FIELD OF THE PRESENT INVENTION

The invention relates to the field of mass spectrometer and mass spectrometry, in particular to a mass spectrometry device and analysis method for gas phase molecule-ion reaction.

DISCUSSION OF THE RELATED ART

A gas phase molecule-ion reaction assay is of great value in understanding and discovering the principles and phenomena of chemical reactions. Among a variety of devices for gas phase molecule-ion reaction experiments, a mass spectrometer with an ion trap is a very powerful tool developed in recent years. The mass spectrometer not only can select and store reaction ions with single mass-to-charge ratio from the complex ion beams generated from an ion source, perform time-controllable molecule-ion reaction with a reaction gas introduced into the ion trap to generate ions as a reaction product, but also can crash the selected ions, react part (i.e. daughter ions) of parent ion structure with gas molecules. Lastly, the mass spectrometer can perform quick spectrometry on the ions as the reaction product to obtain certain reaction results. The current mass spectrometer for molecule-ion reaction based on the ion trap has the following four problems: (1) the gas sample used for the reaction is easy to pollute the ion trap used for delivery of the volatile gas sample and reaction, and introducing different reaction gas samples for new assay will take very long cleaning time; (2) the gas sample used for gas phase reaction with the ions are not quantitatively introduced, and researchers can not study the effect of reaction amount on the reaction; (3) in the full process of ion capture, selection, crashing, reaction and testing, a volatile gas of the sample is always introduced into the ion trap, thus disturbing the reaction with multi-stage daughter ions, as both the second-level daughter ion and third-level daughter ion are likely to react with the gas of the sample; and (4) both the reaction ions and the ions as the reaction product are likely to be very few, it is difficult to obtain the desired detection strength, particularly, it is required to perform qualitative structural testing on the ions as the reaction product, that is, the selection and crashing of a series of ions as the reaction product in the ion trap will also result in loss of a large amount of ions to be tested.

SUMMARY OF THE INVENTION

For the defects of the prior art, the present invention provides a mass spectrometry device and analysis method for gas phase molecule-ion reaction. The mass spectrometry and mass spectrometer according to the present invention can be used to precisely control the molecule-ion reaction amount and reduce pollution of reactants to ion traps and pipelines.

The present invention provides a mass spectrometer for gas phase molecule-ion reaction, comprising:

a reaction gas introduction device and a gas phase molecule-ion reaction mass spectrometer, wherein the reaction gas introduction device is connected with the gas phase molecule-ion reaction mass spectrometer;

the reaction gas introduction device is used to introduce a reaction gas into the gas phase molecule-ion reaction mass spectrometer;

the gas phase molecule-ion reaction mass spectrometer is used for a reaction between molecules and ions and mass spectrometry of a reaction product;

wherein the reaction gas introduction device comprises a reaction gas container being used to contain a gas or volatile liquid or solid and generate gas molecules required for a reaction; and a reaction gas quantitation device used to control flow of the gas molecules; and the gas phase molecule-ion reaction mass spectrometer comprises a vacuum system, an ion source, an ion lens, ion traps, series mass analyzers based on the ion traps, a detector and a control system.

According to the mass spectrometer for gas phase molecule-ion reaction, the gas phase molecule-ion reaction mass spectrometer further comprises an auxiliary reaction gas gasification unit used for accelerating generation of gas molecules from a low volatile sample; an ion trap buffer gas source used to supply a buffer gas with a sufficient pressure inside the ion traps; pipelines used to deliver a gas among valves, gas connections and the ion traps; and a clean gas source used to clear the pipelines and the valves.

According to the mass spectrometer for gas phase molecule-ion reaction, the vacuum system comprises a vacuum chamber for housing the ion lens, the ion traps or the series mass analyzers and the detector; and a vacuum pump for extracting a gas from the vacuum chamber to form a vacuum environment.

The mass spectrometer for gas phase molecule-ion reaction further comprises a mass flow controller used to control flow of the buffer gas and control flow rate of the buffer gas to the ion traps.

According to the mass spectrometer for gas phase molecule-ion reaction, a plurality of the mass spectrometers for gas phase molecule-ion reactions are connected in parallel.

According to the mass spectrometer for gas phase molecule-ion reaction, the gas phase molecule-ion reaction mass spectrometer comprise three ion traps in axial arrangement.

The present invention also provides a means of mass spectrometry for gas phase molecule-ion reaction with a mass spectrometer, the mass spectrometer comprising:

a reaction gas introduction device and a gas phase molecule-ion reaction mass spectrometer, wherein the reaction gas introduction device is connected with the gas phase molecule-ion reaction mass spectrometer;

the reaction gas introduction device is used to introduce a reaction gas into the gas phase molecule-ion reaction mass spectrometer;

the gas phase molecule-ion reaction mass spectrometer is used for a reaction between molecules and ions and mass spectrometry of a reaction product;

wherein the reaction gas introduction device comprises a reaction gas container being used to contain a gas or volatile liquid or solid and generate gas molecules required for a reaction; and a reaction gas quantitation device used to control flow of the gas molecules; and the gas phase molecule-ion reaction mass spectrometer comprises a vacuum system, an ion source, an ion lens, ion traps, series mass analyzers based on the ion traps, a detector and a control system;

the means comprising:

step 1, capturing, by the ion traps, ions to be reacted generated by the ion source for a certain period of time, and selecting new ions to be tested at any mass-to-charge ratio to the ion traps from the ions to be reacted; and step 2, introducing the reaction gas from the reaction gas container into the reaction gas quantitation device and passing the buffer gas through the reaction gas quantitation device to allow the reaction gas to enter the ion traps to react with the new ions to be tested, and performing mass spectrometry on a reaction product.

According to the means of mass spectrometry for gas phase molecule-ion reaction, the step 1 further comprises a step of opening a valve between the vacuum pump and the reaction gas quantitation device to keep the inside of the reaction gas quantitation device in a vacuum state.

According to the means of mass spectrometry for gas phase molecule-ion reaction, buffer gas flow is increased or reduced through the mass flow controller to increase or reduce pressure in the ion traps.

According to the means of mass spectrometry for gas phase molecule-ion reaction, the method further comprises a cleaning step, and the cleaning step further comprises the following steps: removing the reaction gas container and the auxiliary gasification unit, controlling clean gas flow by the mass flow controller, and discharging a clean gas through the reaction gas quantitation device to an atmospheric environment.

Figure 1A:
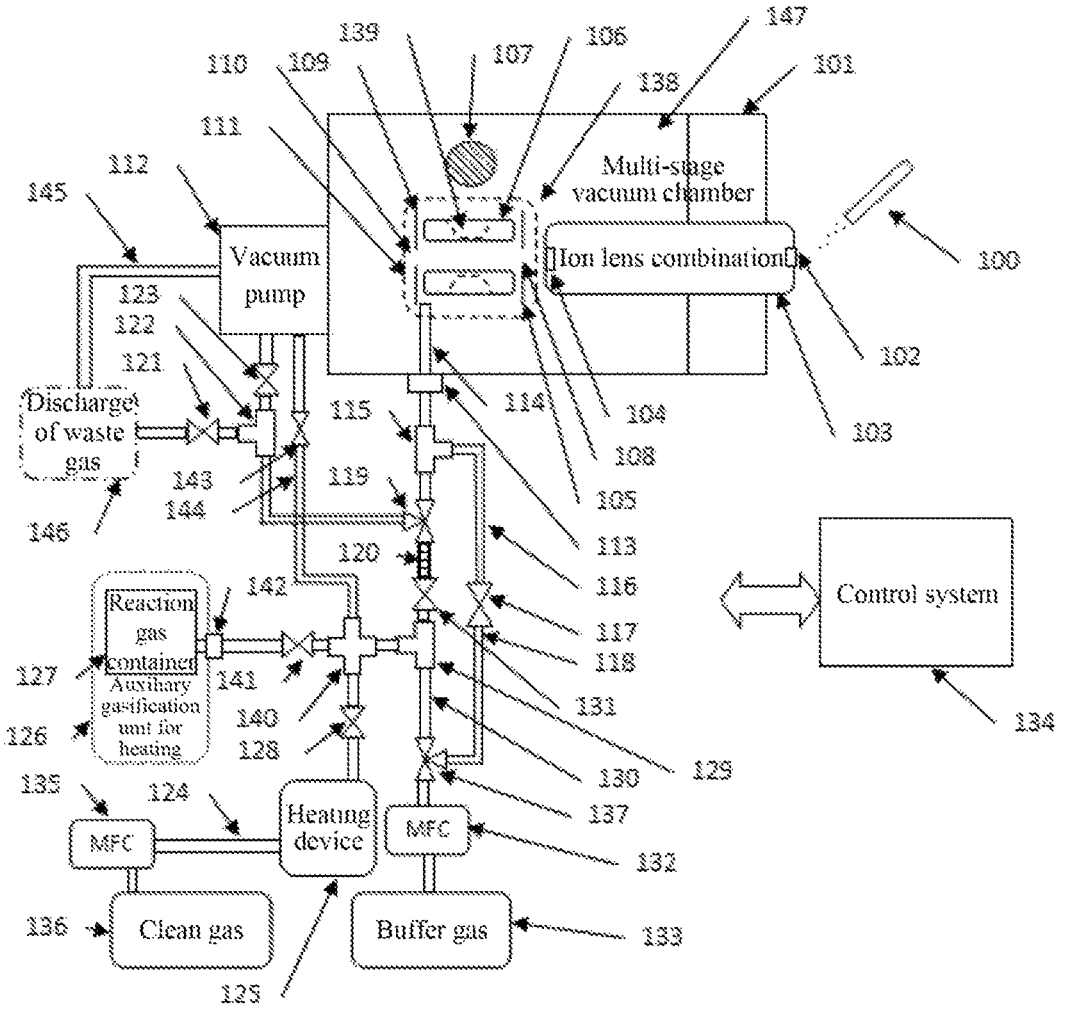
FIG. 1*a* is a structural diagram of a gas phase molecule-ion reaction mass spectrometer based on a single ion trap and a singe reaction gas introduction device.

Electrospray ion source 100;
Multi-stage vacuum chamber 101;
Inlet 102 of ion lens combination;
Ion lens combination 103;
Outlet 104 of ion lens combination;
Front end cap electrode 105;
Electrode 106;
Ion detector 107;
Central hole 108;
Rear end cap electrode 109;
Central hole 110;
Housing 111;
Vacuum pump 112;
Seal connector 113;
Buffer gas/reaction gas introduction tube 114;
Three-way gas connector 115;
Pipeline 116;
Two-way valve 117;
Pipeline 118;
Electric valve 119;
Reaction gas quantitation device 120;
Valve 121;
Three-way connector 122;
Electric two-way valve 123;
Electric two-way valve 124;
Clean gas 125;
Auxiliary gasification unit for heating 126;
Reaction gas container 127;
Valve 128;
Three-way gas connector 129;
Pipeline 130;
Valve 131;
Mass flow controller 132;
Buffer gas source 133;
Control system 134;
Mass flow controller 135;
Clean gas source 136;
Electric three-way valve 137;
Ion trap 138;
Crack 139;
Four-way connector 140;
Valve 141;
Seal connector 142;
Valve 143;
Pipeline 144;
Pipeline 145;
Waste gas exhaust device 146;
High-vacuum area 147;
Vacuum chamber 200;
Reaction gas introduction device 201;
Electrode 202;
Small hole 203;
Ion trap 204;
Cylinder electrode 205;
Electrode 206;
Central small hole 207;
Ion trap 208;
Ion detector 209;
Vacuum chamber area 210;
Vacuum chamber area 211;
Pipeline 213;
Seal connector 214;
Pipeline 215: Seal connector 216;
Vacuum pump 217;
Vacuum chamber 300;
Ion trap 301;
Pipeline 302: Seal connector 303;
Pipeline 305;
Electric two-way valve 307;
Electric two-way valve 312;
Electric two-way valve 313;
Electric two-way valve 314;
Electric two-way valve 315;
Pipeline 316;
Pipeline 317;
Electric two-way valve 318;
Electric two-way valve 319;
Electric two-way valve 320;

DESCRIPTION OF THE PREFERRED EMBODIMENTS

For the problems of the prior art, the present invention provides a mass spectrometry device and analysis method for gas phase molecule-ion reaction, the mass spectrometer comprises a novel reaction gas introduction device and a gas phase molecule-ion reaction mass spectrometer based on ion traps.

The reaction gas introduction device comprises a reaction gas container used to contain a gas or volatile liquid or solid and generate gas molecules required for a reaction; pipelines used to deliver a gas among valves, gas connections and ion traps; an auxiliary reaction gas gasification unit used for accelerating generation of gas molecules from a low volatile sample; an ion trap buffer gas source used to supply a buffer gas with sufficient pressure inside the ion traps and drive the reaction gas (generally high-purity inert gas, such as helium, nitrogen and argon) molecules to enter the ion traps; a clean gas source used to clear the pipelines and valves that are not working so as to take away the gas molecules (generally high-purity or pure inert gas) remaining in the pipelines and valves; a clean gas heating device used to heat the clean gas before the clean gas enters the pipelines and valves to be cleaned, and remove the reaction gas molecules remaining in the pipelines and valves with high-temperature clean gas; and a reaction gas quantitation device that comprises a reaction gas quantitation device, a gas switch valve and a vacuum pumping pipeline.

The gas phase molecule-ion reaction mass spectrometer based on ion traps comprises a vacuum system, an ion source, an ion lens, ion traps, series mass analyzers based on the ion traps, a detector and a control system. The vacuum system comprises a vacuum chamber for accommodating the ion lens, the ion traps and the detector, and a vacuum pump (e.g. mechanical pump, turbo molecular pump) for pumping the gas from the vacuum chamber to produce a vacuum environment. The ion source is used to generate reaction ions, and works in an atmospheric environment (electrospray ion source, for example) or vacuum environment (electron ionization source, for example). The ion lens is a series of devices that are provided with through holes at centers and have electrodes in axial arrangement. A voltage is applied to each electrode for focusing and transporting the ions generated by the ion source into the ion traps, such as chip DC lens, tubular DC lens and RF multipole ion guide. The ion trap is used for capturing and trapping ions. An RF multipole rod can be used as an ion trap, but it does not have the mass resolution capability. An ion trap with good analytical field has a good mass resolution, such as 3D ion trap with a hyperbolic electrodes, 2D linear ion trap with a hyperboloid electrode and 2D linear ion trap with a rectangular electrode. The ion trap generally has two small holes for ions to enter or discharge, and an inert gas is introduced into the ion trap to increase the efficiency of the ion trap to capture ions or the mass resolution thereof. The detector receives an ion signal and generates a corresponding current signal into the control system for storage and analysis. The control system is used to control all the electronic components of the mass spectrometer and can synchronize the work of all the components at the set time sequence.

The present invention also provides a mass spectrometry using the mass spectrometer for gas phase molecule-ion reaction, comprising the following steps:

(1) opening a valve between a buffer gas and an ion trap only to allow the buffer gas to enter the ion trap directly in the initialization period;

(2) using the ion trap to capture ions generated by an ion source for a certain period of time, selecting the ions with the same mass-to-charge ratio by making use of the multi-stage mass spectrometry capability of the ion trap after the ions move stably in the ion trap, remaining such ions in the ion trap, and discharging other ions out of the ion trap or striking them onto the electrode of the ion trap, so that the charge of such ions is lost and such ions cannot participate in the molecule-ion reaction;

(3) opening a valve between a vacuum pump and a reaction gas quantitation device to keep the reaction gas quantitation device in vacuum;

(4) keeping a valve between the reaction gas quantitation device and a reaction gas container open for a certain period of time, and then closing the "valve between the vacuum pump and the reaction gas quantitation device", and then closing the "valve between the gas reaction quantitation device and the reaction gas container", so that a certain amount of the reaction gas is stored in the reaction gas quantitation device;

(5) closing the valve between the buffer gas and the ion trap, while opening the "valve between the reaction gas quantitation device and the buffer gas" and the "valve between the reaction gas quantitation device and the ion trap", so that the buffer gas passes through the reaction gas quantitation device, and drives the reaction gas to enter the ion trap; wherein after a period of time, the gas in the reaction gas quantitation devices will be all injected into the ion trap, such step achieves the reaction between ions and reaction gas in the ion trap, while the reaction gas will not be introduced for reaction in other steps; in this step, a mass flow controller (MFC) for the buffer gas can be controlled to increase or decrease the gas flow rate, so that the pressure in the ion trap is reduced or increased, thereby testing the effect different flows and pressures in the ion trap on the molecule-ion reaction;

(6) restoring the flow rate of the MFC for the buffer gas, so that the ion trap is subject to mass spectrometry to obtain ions as a reaction product; alternatively, using the ion trap to perform multi-stage mass spectrometry on the ions with certain mass-to-charge ratio so as to determine structure information of such ions; and (7) closing the "valve between the reaction gas quantitation device and the buffer gas" and the "valve between the reaction gas quantitation device and the ion trap", and then opening the valve between the buffer gas and the ion trap, so that the buffer gas directly enters the ion trap, at which time, the reaction gas quantification device is also filled with the buffer gas; such step also can be performed before the step (6); and Repeating steps (2) to (7) for a plurality of experiments.

The present invention also provides a method for on-line non-stop vacuum cleaning of the reaction gas quantitation device mainly polluted by a reaction gas sample with the mass spectrometer for gas phase molecule-ion reaction, comprising the following steps:

(1) opening a valve between a buffer gas and an ion trap only to allow the buffer gas to enter the ion trap directly; performing the general mass spectrometry in the following steps;

(2) removing a reaction gas container and an auxiliary gasification unit;

(3) opening "a valve between a reaction gas quantitation device and a clean gas", opening "a valve between the reaction gas quantitation device and the reaction gas container", while starting an MFC for controlling clean gas output and setting it to a proper flow value (e.g. 1 L/min) so as to discharge the clean gas to an atmospheric environment through the reaction gas quantitation device; opening a clean gas heating device, which is useful to remove the reaction gas remaining in the pipeline and the reaction gas quantification device more quickly;

(4) keeping the step (3) ongoing for several minutes and even several hours, depending on the amount of the remaining reaction gas; and (5) mounting a container for containing a fresh reaction gas, and performing molecule-ion reaction according to the operation method for the mass spectrometer for gas phase molecule-ion reaction.

The present invention also provides a molecular-ion reaction mass spectrometer using a plurality of the reaction gas introduction g devices connected in parallel, and the devices are separated by valves, and the operation and cleaning methods of a single device are the same as those described above. The advantage is that when a reaction gas introduction device works, the remaining devices may be in on-line cleaning or ready state. When a reaction gas sample is to be replaced immediately, a second reaction gas introduction device can be used to introduce a second reaction gas, and then the first reaction gas introduction device is in the online cleaning state for later use without waiting for new assay upon replacement of reaction gas, thereby significantly improving the experimental efficiency.

The present invention also provides a device for gathering reaction ions and ions as a reaction product and operation method thereof. The device is based on the mass spectrometer for gas phase molecule-ion reaction, but the ion trap is upgraded to three axially arranged ion traps. There are small holes at the centers of the electrodes in front and back of the axes of the ion traps, so that ions can be transmitted among the three ion traps. The operation method for the molecule-ion reaction is as follows:

(1) sending ions generated by an ion source to a first ion trap through an ion lens and a front end cap hole of the first ion trap and storing such ions in the first ion trap, and gathering reaction ions with the selection and fragmentation function of the ion trap;

(2) transferring the ions gathered in the first ion trap through the central hole of a rear end cap electrode of the first ion trap and a front end cap of a second ion trap into the second ion trap for storage; repeating steps (1)-(2), and further gathering reaction ions with the second ion trap or gathering the daughter ions generated by the first ion trap with a fragmentation function; and communicating the second ion trap with the reaction gas introduction device to perform molecule-ion reaction at specified time upon gathering;

(3) transferring the ions as a reaction product generated upon the molecule-ion reaction in the second ion trap through a central hole of a rear end cap of the second ion trap and a central hole of a front end cap of a third ion trap to the third ion trap for storage; repeating steps (1) to (3) for a plurality of times to gather ions as a reaction product in the third ion trap; and (4) using the third ion trap to fully scan the transmitted ions as a reaction product or performing multi-stage mass spectrometry on the ions with certain mass-to-charge ration to obtain the mass spectral information of the ions as a reaction product.

It should be further noted that the second ion trap is mainly used for molecular-ion reaction instead of mass-to-charge ratio analysis. Low-cost RF multipole pole (e.g. hexapole and octupole) can be used as the ion trap for ion storage. As the first and third ion traps require mass resolution, ion trap with double curved surface electrode or rectangular surface electrode can be selected. It is best to place the second ion trap and the first and third ion traps in vacuum chambers with different degrees of vacuum, which is possible to prevent the reaction molecules from entering the first and third ion traps or to arbitrarily change the pressure in the second ion trap so as to significantly change the external vacuum pressure of the first and third ion traps.

Embodiment 1 of the present invention is described as follows:

A gas phase molecular-ion reaction mass spectrometer for injecting reaction gas into an ion trap at specified time so as to carry out a molecule-ion reaction, as shown in FIG. 1*a*, comprises a mass spectrometer and a reaction gas introduction device.

The mass spectrometer is described as follows: an electrospray ionization source 100 generates ions in the atmospheric environment, ions enter a multistage vacuum chamber 101 of the mass spectrometer through an inlet 102 of an ion lens combination, and the ion lens combination 103 transfers ions from the atmospheric environment to a high-vacuum area 147 where the ion trap 138 is located, and flows the ions out of an outlet 104 of the ion lens combination 103. The ions enter a central region of an ion trap 138 from a central hole 108 of a front end cap electrode 105 of the ion trap 138. The ion trap 138 is a two-dimensional linear ion trap with a double curved surface electrode, and is provided with a front end cap electrode 105, a rear end cap electrode 109, four parallel electrodes 106 whose inner surfaces are double curved surfaces and a housing 111. Ions enter from 108 and are bound by an electromagnetic field generated by an RF high voltage on 106 so as to be trapped in the central region of the ion trap 138. The rear end cap electrode 109 controls the ions not to flow out in the axial direction, and has a central hole 110. When a proper voltage is applied to the 105, 106 and 109, the ions flow out of the ion trap through 110. The center of the electrode 106 has a crack 139. When a proper voltage value is scanned by the RF voltage on the electrode 106, the ions may be shot off from the crack 139 of the center of 106. When an ion detector 107 is placed outside the 139, an ion signal can be detected and output to a control system 134 for processing into mass spectrometry data. The housing 111 of the ion trap, wrapped around the ion trap, is opened only at positions corresponding to a buffer/reaction gas introduction tube 114, of 108, 109 and 107, so that a differential pressure is formed between the inside and outside of the ion trap when the external gas passes through the 114 into the ion trap, and a high pressure exists in the ion trap so as to increase the capturing efficiency of the ion trap and improve the mass resolution. The control system 134 is used for generating electrical signals required for the ion source, the electrodes, the electric valves and the mass flow controller (MFC), and monitoring the operating status signals of the respective components and reading the fast electrical signals generated by the ion detector 107. The control system 134 is capable of synchronizing the timing, and can output the electric signals required for the operation of the components synchronously.

Figure 1B:
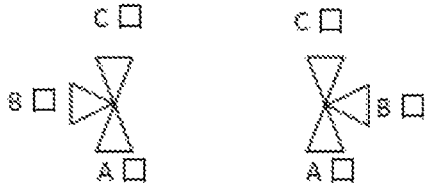
FIG. 1*b* is a marking pattern showing a connection interface of an electric three-way valve used in the device.

The reaction gas introduction devices are described as follows: a buffer gas source 133 is generally a high pressure cylinder storing high purity helium, and helium allows the ion traps to have a good mass resolution. An outlet of the 133 was connected to a mass flow controller (MFC) 132, reaction gas at a stabilized flow rate flew into a port A (see FIG. 1*b*) of an electric three-way valve 137, and then was divided into two streams, one stream was connected to a three-way gas connector 129 through a pipeline 130, and the other stream flew in an electric two-way valve 117 through a pipeline 118. The two-way valve 117 could switch on/off helium into a pipeline 116. The gas flowing in the pipeline 116 was divided into two streams after reaching a three-way gas connector 115, one stream was communicated with a port C (See FIG. 1*b*) in a gas passage of an electric three-way valve 119, and the other stream was communicated with the inner space of the ion traps through a pipeline 114. The pipeline 114 was connected with a vacuum chamber 101 through a seal connector 113 to prevent external gas entering the vacuum chamber through a gap between the pipeline 114 and the vacuum chamber 101. For ordinary mass spectrometry, the port A and the port B of the three-way valve 137 were communicated, the two-way valve 117 was switched on, helium flew from the MFC through the pipelines 118 and 116 into the pipeline 114, and then flew into interior areas of the ion traps.

Figure 2:
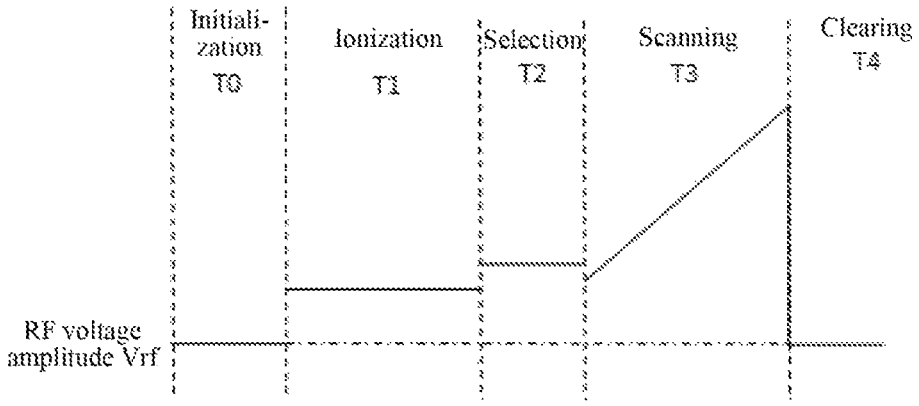
FIG. 2 is a scan sequence diagram of an RF high voltage driving the ion trap under mass spectrometry.

In order to achieve mass spectrometry within a specified time, the injection time of the reaction gas was synchronized with the timing of changes in RF high voltage amplitude on electrodes 116 of the ion traps. FIG. 2 shows operation timing of the ion traps to control RF high voltage amplitude in a cycle with ions at a single mass-to-charge ratio. Although other components such as auxiliary excitation signals and gate lens voltage in the ion lens were available to control the ion traps, the changes were synchronized with RF high voltage, which was no repeated in the figures accordingly. Changes in RF high voltage were realized in 5 steps: at an initialization time T0, all components were stabilized, and ions in the ion source could not enter the ion traps; during an ionization period T1, ions generated by the ion source could pass through the ion lens into the ion traps, and were captured by RF fields of the ion traps; during a selection period T2, ions at undesirable mass-to-charge ratios were in an unstable state and expelled from the ion traps under the action of an auxiliary excitation signal of the ion traps, leaving ions at a single mass-to-charge ratio to be reacted; during a scanning period T3, RF high voltage amplitude was scanned, ions in the ion traps were expelled to an ion detector by mass-to-charge ratios, producing an electric signal expressing a mass spectrum; and during a clearing period T4, RF high voltage dropped to 0V, all ions trapped in the ion traps became unstable and were thus expelled, leaving no ion in the ion traps.

A reaction gas should be introduced between the selection period T2 and the scanning period T3 shown in FIG. 2 for introducing the reaction gas within a specified time. The timing for synchronous control of related components was shown in FIG. 3. Relative to FIG. 2, a reaction period T3 was inserted between the selection period T2 and the scanning period T4 in the amplitude Vrf change timing of RF high voltage for introduction of the reaction gas into the ion traps, and for molecule-ion reaction with ions stored in the ion traps. The complete operation process is described as follows:

(1-1) During an initial time T0, residual gas 1 was removed from a space for the reaction gas from the reaction gas introduction device, only buffer helium entered the ion traps through a valve 117 at the moment; meanwhile, an electric two-way valve 123 connected to a vacuum pump was open, an electric three-way valve 119 was in a state in which the ports AB were communicated, an electric two-way valve 131 was open, and an electric two-way valve 141 was closed to extract residual gas in the inner space of the reaction gas quantitation device 120 and a pipeline thereof to form a vacuum, so that reaction gas introduced in such space had a higher purity. The 120 could be simply designed with a capillary made of stainless steel, copper, polyether-ether-ketone (PEEK), quartz glass or titanium usually based on whether the reaction gas reacts with the material. As the length and inner diameter of the 120 were known, the volume of the internal space was also known, thus the amount of the reagent gas introduced in the quantitation device 120 was determined if the charging period was certain.

(1-2) During the ionization period T1, the control timing for the reaction gas introduction device was subdivided into two periods: a charging period T11 and a holding period T12. During the charging period T11, an electric two-way valve 141 was open to allow the reaction gas in a reaction gas container 127 to volatilize into the 120 and nearby pipelines thereof, and the valve 123 connected to the vacuum pump remains open to allow the reaction gas to be uniformly distributed in the filling space. The reaction gas container 127 was connected to the valve 141 through a seal connector 142, so that external gas was kept away. For some liquid or solid reaction gas with low volatility, an auxiliary gasification unit such as a heating or ultrasonic unit could be applied. In the example, an auxiliary heating gasification unit 126 was applied to heat the reactor container to improve the volatilization efficiency usually at a constant temperature so that the amount of the reactant gas charged in the 120 in a unit time was constant. During the holding period T12, the valve 141 was closed to prevent charging gas from the reaction gas container into a reactor; the valve 131 was closed to isolate the quantitation space 120 and the pipeline between the quantitation space 120 and the reaction gas container 127. The reaction gas in the pipeline was not introduced into the ion traps due to difficult calculation and operation.

(1-3) During the selection period T2, residual gas 2 was removed from the reaction gas introduction device, an electric two-way valve 143 connected to a vacuum pump 112 was open at the moment, and the quantitation space 120 and the inner space of the pipeline between the quantitation space 120 and the reaction gas container 127 was extracted to form a vacuum so as to prevent charging reaction gas from such space into the ion traps.

(1-4) During the reaction period T3, for the reaction gas introduction device and the mass spectrometer, the reaction gas was introduced into the ion traps for molecule-ion reaction in the ion traps. At the moment, the electric two-way valve 143 was closed, and the valve 117 was closed to stop introducing a buffer helium from the 117 into the ion traps; meanwhile, the valve 137 was switched to a state in which the ports A/C were communicated, the valve 131 was open, the electric three-way valve 119 was switched to a state in which the ports A/C were communicated, and the buffer helium passed through the port C of the valve 137 into a pipeline 130, passed through the valve 131 to push the reactant gas inside the 120, flew through ports A, C of the valve 119 into the pipeline 114, and flew into the ion traps. As the amount of gas inside the 120 was known, the flow rate of the buffer helium could be controlled by an MFC 132, the inflow time of the reaction gas flowing into the ion traps was also calculable and controllable. The setting of the reaction time T3 was usually more than the calculated inflow time, depending on experimental data.

(1-5) During the scanning period T4, the ion traps were scanned to produce mass spectrometry data. At the moment, the molecule-ion reaction was substantially completed while the valve 117 was open, the valve 137 was switched to a state in which the ports A/B were communicated, and the valve 119 was switched to a state in which the ports A/B were communicated, a channel in the 120 for gas to enter the ion traps was cut off, and only the buffer helium entered the ion traps through the valve 117, thereby performing normal mass spectrometry data scanning. Of course, a plurality of ions obtained after the reaction could be subject to multi-stage mass spectrometry. During the period, as the reaction gas quantitation space and the pipeline thereof are isolated from the buffer gas pipeline connected to the ion traps through valves without interaction, residual gas 1 could be removed during the T0 period.

(1-6) During the clearing period T5, a control system 134 performed mass spectrometry data processing or removed the residual gas 1, and then proceeded to the next T0-T5 experimental operation.

(1-7) It should be further stated that, for the four-step operation of "removing residual gas 1", "charging gas T11", "holding T12" and "removing residual gas 2" for the reaction gas introduction devices, the time for each step was not necessarily in strict synchronization with the operations of "initializing T0", "ionizing T1" and "selecting T2" of RF voltage, but synchronization of the total time of the two operating sequences was required, that is, the first four steps were completed for the reaction gas introduction devices prior to the "reaction T3".

Embodiment 2 of the present invention is shown as follows:

A pipeline should be cleaned to eliminate influence of residual gas from the previous reaction gas before replacing with a new reaction gas sample. According to the idea of the present invention, the pipeline can be rapidly cleaned without releasing vacuum. During the cleaning, the buffer gas entering the ion traps is not influenced, and ordinary mass spectrometry can be performed. An example to implement such a cleaning method is shown in FIG. 1*a*, the specific operation procedure is as follows:

(2-1) A valve 119 and a valve 137 were in a state in which ports A/B were communicated, a valve 117 was open, the buffer gas passed through the valve 117 into an ion trap 138, a reaction gas could not enter the ion traps and a buffer gas pipeline, the mass spectrometer could perform normal mass spectrometry and perform mass spectrometry on ion information generated by an ion source 100.

(2-2) A valve 123 and a valve 143 were closed, and an extraction port of a vacuum pump was isolated from a reaction gas pipeline.

(2-3) A seal connector 142 was unscrewed, a reaction gas container 127 and an auxiliary gasification unit 126 were removed, then one end of a pipeline 144 was hermetically connected to the 142, and the other end of the pipeline 145 was connected to an exhaust extractor 146.

(2-4) A mass flow controller (MFC) 135 corresponding to a clean gas 125 was turned on, and a heating device 125 was turned on at the same time, and meanwhile, a valve 128, a valve 141, a valve 131 and the valve 143 were open. In the state, the heated clean gas passed through two paths into the exhaust extractor 146: one path passed through a four-way connector 140, the valve 141, a connector 142 and associated pipelines thereof into the 146 to remove residual reaction gas interior, particularly on inner walls thereof; and the other path passed through the four-way connector 140, a tee connector 129, the valve 131, the reaction gas quantitation device 120, A/B ports of a valve 119, a tee connector 122, a valve 121 and associated pipelines thereof into the 146 to remove residual reaction gas interior, particularly on inner walls thereof.

(2-5) Another reaction gas could be reloaded after the cleaning process lasted for some time. Before a new reaction gas container is reloaded, the MFC 135, the heating device 125, the valve 128, the valve 121 and the valve 131 were turned off, and then a pipeline between the 142 and the 146 was removed, the new reaction gas container 127 was mounted to the connector 142 and tightened to a sealed state, and the auxiliary gasification unit 126 was also mounted on the 127, then the valve 141 and the valve 143 were open to extract air brought in related valves and pipelines while replacing the reaction gas container and clean gas injected during cleaning. The valve 141 and the valve 119 were closed, and the valve 131 and the valve 123 were open to extract residual clean gas from related pipelines of the valve 131, the reaction gas quantitation device 120, the valve 119 and the tee connector 122 so as to keep a vacuum state inside the related pipelines.

(2-6) After the process was complete, a new reaction gas can be used for a molecule-ion reaction test.

Figure 4:
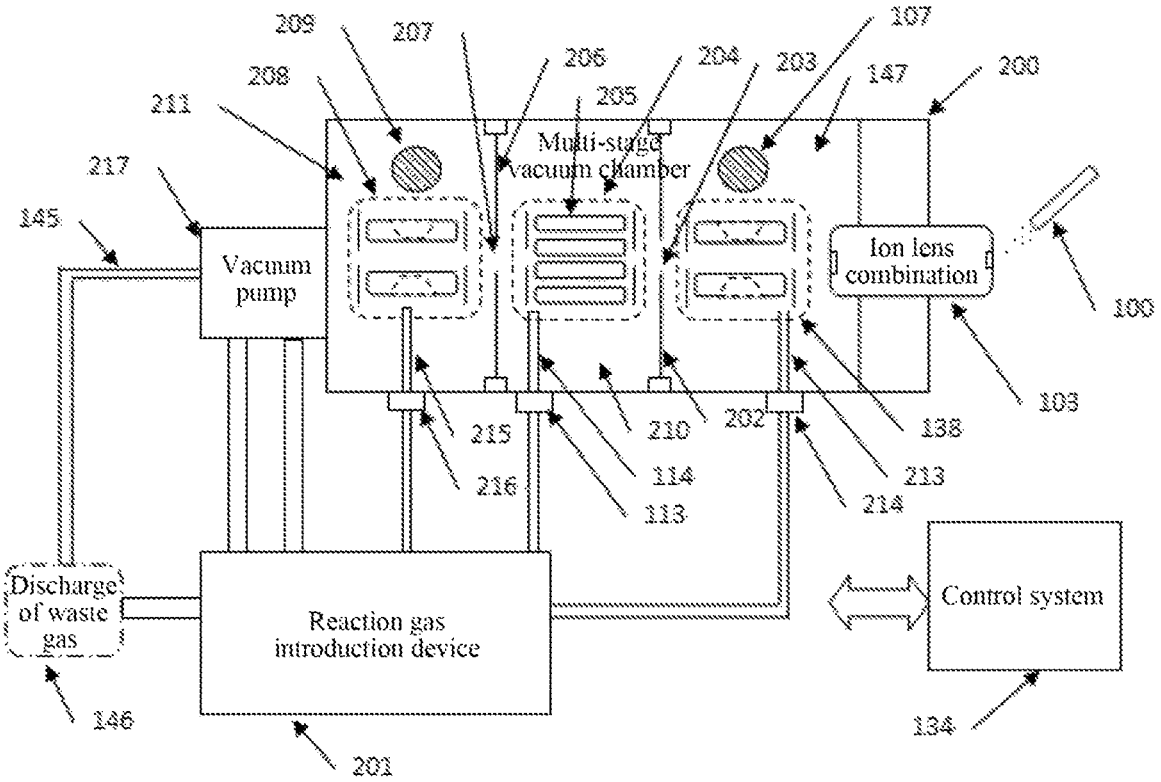
FIG. 4 is a structural diagram of a gas phase molecule-ion reaction mass spectrometer based on a plurality of ion traps and a singe reaction gas introduction device.

Embodiment 3 of the present invention is shown as follows:

In practical applications, reactive ions are required to be enriched due to the large amount needed and reaction product ions are usually required to be enriched due to less amount. In the case, an example of the solution proposed according to the idea of the present invention is shown in FIG. 4. As an ion enrichment method is mainly described in the example, reaction gas and buffer gas introduction devices are simplified in FIG. 4, a box referred to by 201 stands for the reaction gas introduction devices. The design idea of the 201 is similar to that in FIG. 1*a*. The main improvement of the example over the embodiment 1 is a vacuum chamber and ion traps.

With respect to the multi-stage vacuum chamber 101 shown in FIG. 1*a*, the vacuum chamber 200 of the example was additionally provided with two-stage vacuum chamber regions 210 and 211 behind a high vacuum region 147 where the ion trap 138 is located, and two ion traps 204 and 208 were arranged respectively, the 210 and the 211 were communicated with a turbo-molecular pump (concealed in a vacuum pump 217, the specific connection method can refer to the manual of the molecular pump manufacturer) so that the three regions 147, 210 and 211 could have different vacuum degrees, vacuum degrees between the region 147 and the region 201 were isolated by an electrode 202, the 202 was sealed and insulated from a chamber housing, gas flow between the 147 and the 201 was achieved only through a small hole 203 in the center of the 202, and ion transmission between the ion trap 138 and the ion trap 204 was achieved with the help of the 203. Similarly, the electrode 206 and a small hole 207 in the center thereof also achieved the same functions as the 202 and the 203 for isolating vacuum degrees of the regions 210 and 211 and achieving ion transmission between the ion traps 208 and 204.

The ion traps 138 and 208 for mass spectrometry shall be ion traps with a high quality resolution. In the example, 2D linear ion traps for hyperboloid electrodes were selected. With the same characteristics as those described in embodiment 1, corresponding ion detectors 107 and 209 were used for converting ions emitted by scanning the ion traps into electrical signals to a control system for processing into mass spectrometry data, the 138 and the 208 were only introduced with an appropriate amount of high purity helium, the high purity helium flew through a pipeline 213 from the 201 into the ion trap 138, and flew through a pipeline 215 into the ion trap 208. The pipeline 213 and the pipeline 215 were fixed to the vacuum chamber 200 with seal connectors 214 and 216 respectively. The ion trap 204 was used for realizing a molecule-ion reaction, a reaction gas or a mixture of reaction gas/buffer gas output by the 201 flew through the pipeline 114 into the ion trap 204. The 204 was mainly used for storing ions, and could transmit reaction product ions to the ion trap 208 or 138 for testing, as a result, the 204 did not require an ion trap with a mass resolution, the ion trap could be realized by using a quadrupole rod or multipole rod with less mechanical precision. In the example, an octopole rod for round rod electrodes was used to realize the ion trap, an RF electrode thereof was composed of 8 cylindrical electrodes 205 arranged in parallel, an RF voltage was applied thereon to form an RF electric field in an area enclosed by the cylindrical electrodes. The octopole rod could trap ions, and was also provided with front and rear cover electrodes similar to those of the ion trap 138, and a DC voltage was applied to control axial motion of ions.

Specifically, when the device shown in FIG. 4 was operated, the ion trap 138 was used to select ions generated by the ion source as reactive ions, the ion trap 204 was used to enrich the reactive ions and perform a molecule-ion reaction, and the ion trap 208 was used to enrich reaction product ions or enrich reaction product ions at a mass-to-charge ratio.

The operation procedure is described as follows:

(3-1) First, lens voltage was controlled to allow ions generated by the electrospray ion source 100 to enter the ion trap 138, as voltage on a rear cover electrode of the 138 was relatively high, the ions could not pass through the 138 and were trapped in the 138, voltage of an ion lens combination was controlled after time t, then subsequent ions could not enter the ion trap 138.

(3-2) Ions were selected or fragmented in the ion trap 138, and parent ions or fragment ions (daughter ions) at a mass-to-charge ratio were selected as reactive ions.

(3-3) Voltage on a rear cover, a hyperboloid electrode and a front cover of the ion trap 138 was changed to allow reactive ions trapped in the 138 to move toward the rear cover, and the reactive ions in the 138 were transmitted to the ion trap 204 under the action of electric fields generated by voltage on the electrode 202 and voltage on electrodes of the ion trap 204, as voltage on a rear cover electrode of the 204 was relatively high, the ions could not pass through the 204 and were trapped in an RF field of the 204.

(3-4) The steps (3-1) through (3-3) were repeated for multiple times to realize selective enrichment of reactive ions, and the ion trap 204 was filled with sufficient reactive ions.

Figure 3:
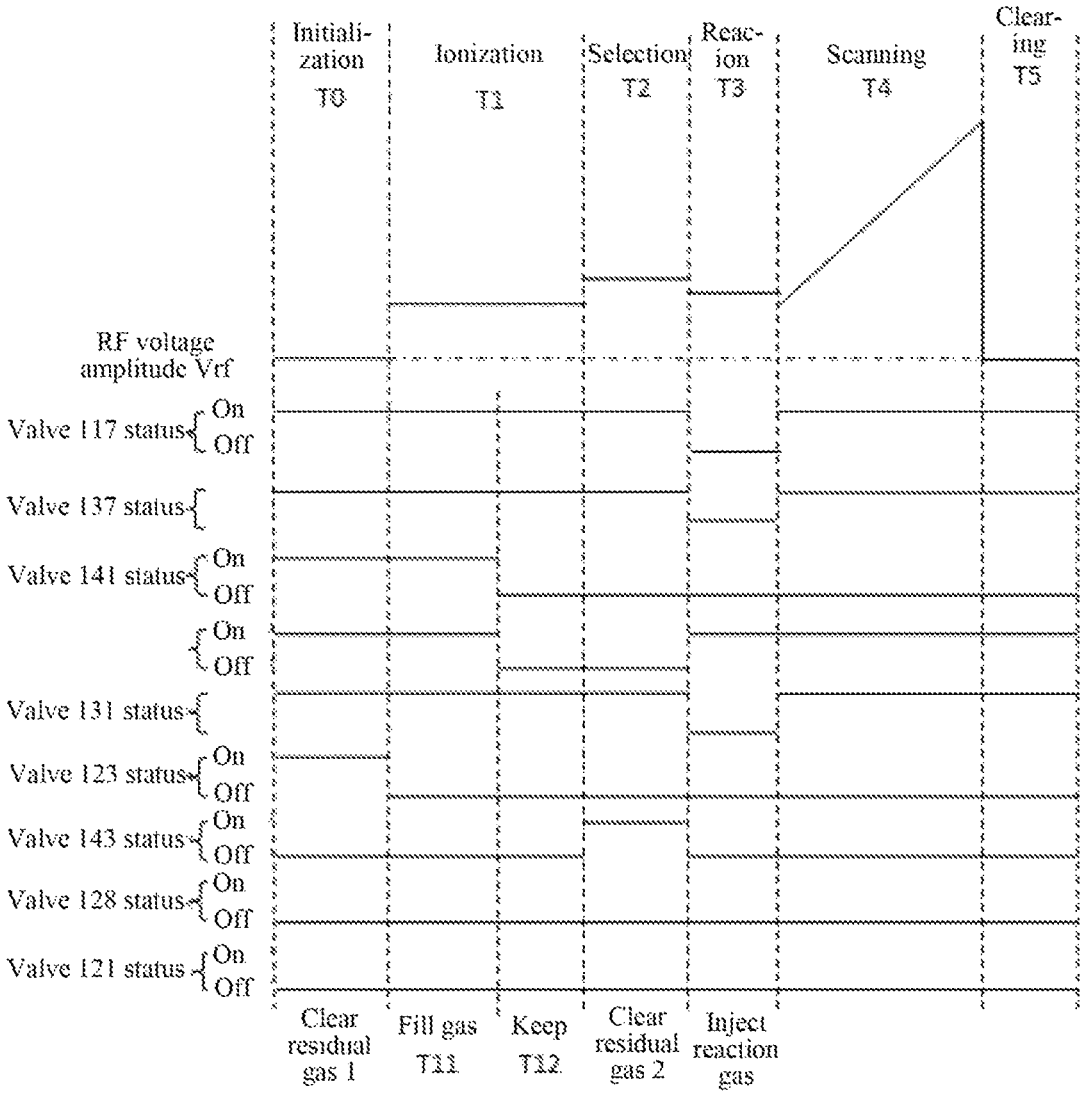
FIG. 3 is a sequence diagram showing simultaneous operation of RF high voltage scanning on the ion trap performing molecule-ion reaction with the spectrometer as shown in FIG. 1*a* and valve switching.

(3-5) With regard to operation timing, the steps (3-1) through (3-4) were equivalent to operation timing T0 through T2 shown in FIG. 3, the ion trap 204 was prepared for a molecule-ion reaction at the moment, and meanwhile, in the steps (3-1) through (3-4), the reaction gas/buffer gas introduction device completed operations of "removing residual gas 1", "charging gas T11", "holding T12" and "removing residual gas 2" according to the timing shown in FIG. 3, therefore, operations of "reaction T3" and "injecting a reaction gas" shown in FIG. 3 were performed in the steps to allow the reaction gas to enter the ion trap 204 from the device 201 for reaction with the reactive ions trapped in the 204 to produce reaction product ions.

(3-6) After the completion of the reaction period T3, mass spectrometry was not performed immediately, instead, the reaction product ions in the ion trap 204 were transmitted to the ion trap 208 by controlling front and rear cover electrodes of the 204, an RF electrode of the 204, an electrode 207, front and rear cover electrodes of the ion trap 208, and DC voltage on an RF electrode of the 208, as voltage on the rear cover electrode of the 208 was relatively high, the ions could not pass through the 208 and were trapped in an RF field of the 208.

(3-7) The steps (3-1) through (3-6) were repeated for multiple times so that more reaction product ions were enriched in the ion trap 208.

(3-8) The operation of "scanning T4" shown in FIG. 3 was implemented on an ion trap 308 by leveraging a mass spectrometry function of the 308 to perform mass spectrometry on the reaction product ions, of course, ions at a mass-to-charge ratio could be subject to fragmented multistage mass spectrometry.

(3-9) It should be further stated that the three ion traps could also be located in chambers at the same vacuum degree to implement the above-mentioned operations; or located in chambers at different vacuum degrees, so that the ion traps 138 and 208 were in a vacuum environment beneficial to mass resolution while a large amount of gas was introduced in the ion trap 204 and reaction at a high atmospheric pressure was observed, and the ion detectors 209 and 107 were susceptible to damage when the atmospheric pressure was too high.

Figure 5:
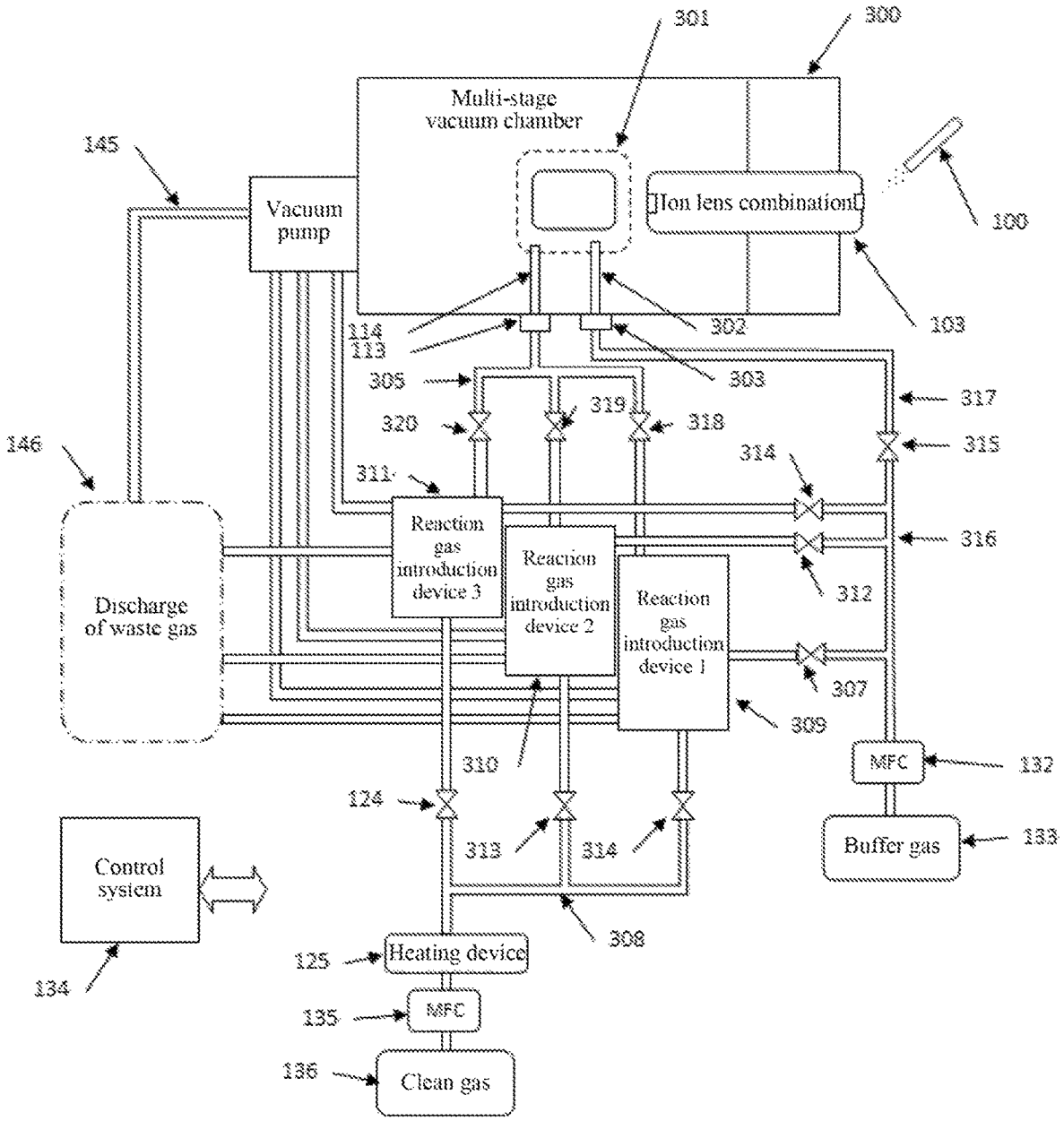
FIG. 5 is a structural diagram of a gas phase molecule-ion reaction mass spectrometer based on a plurality of reaction gas introduction devices connected in parallel.

Embodiment 4 of the invention is shown as follows:

If a plurality of reaction gases are required to rapidly carry out molecule-ion reactions without waiting for the cleaning process described in embodiment 2, a molecule-ion reaction mass spectrometer shown in FIG. 5 can be developed according to the idea of the present invention. The mass spectrometer shown in FIG. 5 is mainly characterized in that groups (three groups in the example) of reaction gas introduction devices are arranged in parallel, each group of devices can be independently emptied or charged without interaction. When a group of devices are used for a molecule-ion reaction, the other groups can be kept in a ready state or in a cleaning state.

The structure shown in FIG. 5 is described as follows: the vacuum chamber 300 can be designed as the structure of the chamber 101 of a single ion trap shown in FIG. 1*a*, or the structure of the chamber 200 of a plurality of ion traps shown in FIG. 4. The ion trap 301 can be a single trap shown in FIG. 1*a*, or a plurality of traps shown in FIG. 4. The reaction gas introduction devices 1, 2, 3, i.e., the marked 309, 310, 311, are three groups of reaction gas introduction devices of the same structure, the structure is substantially the same as that of the reaction gas introduction devices described in FIG. 1*a*, each group of reaction gas introduction device has an independent reaction gas container 127, a reaction gas quantitation device 120 as well as related pipelines and valves. The three groups of reaction gas introduction devices share the clean gas source 136 and the MFC 135 thereof and the heating device 125. Outputs of the 125 are connected to electric two-way valves 124, 313 and 314 respectively through pipelines 308 arranged in parallel, and then communicated with clean gas output ports of the reaction gas introduction devices 1, 2, 3 respectively. The 308 can be designed on the basis of the four-way gas circuit connector 140 shown in FIG. 1*a*, or realized by machining a single four-way mechanical part. The three groups of reaction gas introduction devices also share the buffer gas source 133 and the MFC 132 thereof. Outputs of the 132 are communicated with buffer gas output ports of the reaction gas introduction devices 1, 2, 3 and pipelines 317 respectively through pipelines 316 arranged in parallel and the electric two-way valves 307, 312, 314 and 315. The 316 is designed by a method similar to that of the 308. In the example, pipelines through which gas is charged in the ion trap 301 are designed as 114 and 302, the 114 is used for introducing a mixture of a reaction gas and a buffer gas, and the 302 is used for introducing a pure buffer gas. Of course, the pipelines 317 can be connected to pipelines 305 based on the description in embodiment 1 and the principle of FIG. 1*a*, so that the mixture and the pure buffer gas can be charged in the ion trap 301 through the pipeline 114. Both methods are in accordance with the idea of the present invention, outputs of the reaction gas introduction devices 1, 2, 3 are connected with electric two-way valve 318, 319, 320 respectively and then connected to the pipelines 104 through the shared pipelines 305, so that each of the reaction gases can be fed from the pipelines 104 into the ion trap 301. The pipelines 305 are designed by a method similar to that of the 308. The seal connector 303 is used to seal the pipeline 302 to the vacuum chamber 300, and has a function similar to that of the 113.

The mass spectrometer shown in FIG. 5 is a further update of the mass spectrometer shown in FIG. 1*a* and FIG. 4. When a reaction gas is introduced through a reaction gas introduction device or during cleaning, a corresponding input/output valve is open, the operation method is substantially the same as that in the examples, but is more convenient, and can improve the experimental efficiency when different reaction gases are introduced.

The present invention may also have other various embodiments. Those skilled in the art should be able to make various corresponding changes and modifications in accordance with the present invention without departing from spirit and essence of the present invention, but such corresponding changes and modifications should be incorporated in the protection scope of appended claims of the present invention.

INDUSTRIAL APPLICATIONS

The mass spectrometer and the mass spectrometry for gas phase molecule-ion reaction provided by the present invention have the following advantages and applications:

The mass spectrometry and mass spectrometer of the present invention allow the gas introduction time to be synchronized with the operation timing of ions in the ion traps, i.e., reaction gas is introduced only in the set time, which can significantly reduce contamination of reaction gas to apparatus, and introduce reaction gas quantitatively. In addition, reactive ions and reaction product ions can be fully enriched in a gas phase environment based on the spectrometer and the operation method with multiple ion traps further provided by the present invention, producing an ideal number of reactive ions and an ideal number of reaction product ions.

The invention claimed is:

1. A mass spectrometer for gas phase molecule-ion reaction, comprising:

a reaction gas introduction device and a gas phase molecule-ion reaction mass spectrometer, wherein the reaction gas introduction device is connected with the gas phase molecule-ion reaction mass spectrometer;

the reaction gas introduction device is used to introduce a reaction gas into the gas phase molecule-ion reaction mass spectrometer;

the gas phase molecule-ion reaction mass spectrometer is used for a reaction between molecules and ions and mass spectrometry of a reaction product;

wherein the reaction gas introduction device comprises a reaction gas container being used to contain a gas or volatile liquid or solid and generate gas molecules required for a reaction; and a reaction gas quantitation device used to control flow of the gas molecules; wherein the gas molecules generated by the reaction gas container enter the reaction gas quantitation device, and after a flow rate control by the reaction gas quantitation device, the gas phase molecular-ion reaction mass spectrometer is introduced;

the reaction gas quantitation device is hollow inside, and two ends of the reaction gas quantitation device are respectively provided with a valve one and a valve two, and the valve one controls connection and closure of a gas path between the reaction gas quantification device and a vacuum pump or the gas phase molecular-ion reaction mass spectrometer; the valve two controls connection and closure of a gas passage between the reaction gas quantitation device and the reaction gas container;

a controller configured to operate the first and second valves so that in a first period, the valve one opens, and an inner space of the reaction gas quantitation device is connected with the vacuum pump, the vacuum pump pumps the gas from the inner space of the reaction gas quantitation device to form a vacuum; in a second period, the valve two opens, the reaction gas in the reaction gas container enters the vacuum formed in the reaction gas quantitative device, so that the vacuum pump is not connected with the reaction gas quantitation device; according to a length and an inner diameter of the inner space of the reaction gas quantitation device, a volume of the inner space of the reaction gas quantitation device is determined; and according to the determined volume and an inflation time, an amount of reaction gas rushed into the reaction gas quantitative device is determined; in a third period, the valve two closes, so that the gas path of the reaction gas quantitative device and the gas phase molecular-ion reaction mass spectrometer is connected through the valve one and the reaction gas in the reaction gas quantitative device is supplied to the gas phase molecule-ion reaction mass spectrometer; and wherein in the third period a buffer gas flow rate is controlled so the inflow time of reaction gas into the gas phase molecule-ion reaction mass spectrometer is calculated and controlled based on the amount of reaction gas determined;

the gas phase molecule-ion reaction mass spectrometer comprises a vacuum system, an ion source, an ion lens, ion traps, series mass analyzers based on the ion traps, a detector and a control system.

2. The mass spectrometer for gas phase molecule-ion reaction according to claim 1, wherein the gas phase molecule-ion reaction mass spectrometer further comprises an auxiliary reaction gas gasification unit used for accelerating generation of gas molecules from a low volatile sample; an ion trap buffer gas source used to supply a buffer gas with a sufficient pressure inside the ion traps; pipelines used to deliver a gas among valves, gas connections and the ion traps; and a clean gas source used to clear the pipelines and the valves.

3. The mass spectrometer for gas phase molecule-ion reaction according to claim 1, wherein the vacuum system comprises a vacuum chamber for housing the ion lens, the ion traps or the series mass analyzers and the detector; and a vacuum pump for extracting a gas from the vacuum chamber to form a vacuum environment.

4. The mass spectrometer for gas phase molecule-ion reaction according to claim 2, further comprising a mass flow controller used to control flow of the buffer gas and control flow rate of the buffer gas to the ion traps.

5. The mass spectrometer for gas phase molecule-ion reaction according to claim 1, wherein a plurality of the mass spectrometers for gas phase molecule-ion reaction are connected in parallel.

6. The mass spectrometer for gas phase molecule-ion reaction according to claim 1, wherein the gas phase molecule-ion reaction mass spectrometer comprises three said ion traps in axial arrangement.

* * * * *